US009993051B2

(12) United States Patent
Kaltenrieder et al.

(10) Patent No.: US 9,993,051 B2
(45) Date of Patent: Jun. 12, 2018

(54) BRACELET CLASP COMPRISING A DEVICE FOR ADJUSTING THE USEFUL LENGTH OF THE BRACELET

(71) Applicant: THE SWATCH GROUP MANAGEMENT SERVICES AG, Biel/Bienne (CH)

(72) Inventors: Cedric Kaltenrieder, Courtelary (CH); Rocco Catanese, Bienne (CH)

(73) Assignee: THE SWATCH GROUP MANAGEMENT SERVICES AG, Biel (CH)

( * ) Notice: Subject to any disclaimer, the term of this patent is extended or adjusted under 35 U.S.C. 154(b) by 282 days.

(21) Appl. No.: 14/540,793

(22) Filed: Nov. 13, 2014

(65) Prior Publication Data

US 2015/0181988 A1 Jul. 2, 2015

(30) Foreign Application Priority Data

Dec. 26, 2013 (EP) ..... 13199618

(51) Int. Cl.
*A44C 5/24* (2006.01)

(52) U.S. Cl.
CPC ..... *A44C 5/24* (2013.01); *A44C 5/246* (2013.01); *Y10T 24/213* (2015.01)

(58) Field of Classification Search
CPC ..... A44C 5/24; A44C 5/246; Y10T 24/4782
See application file for complete search history.

(56) References Cited

U.S. PATENT DOCUMENTS 2,500,649 A * 3/1950 Szeglin ..... A44C 5/246 24/71 J
2,542,358 A * 2/1951 Ritter ..... A44C 5/246 24/71 R
2,596,186 A * 5/1952 Volk ..... A44C 5/246 24/71 J (Continued)

FOREIGN PATENT DOCUMENTS

EP 0 350 785 B1 7/1989
EP 0 793 924 A1 3/1997

(Continued)

OTHER PUBLICATIONS

European Search Report of EP 13 19 9618, dated Jun. 20, 2014. English Translation.

*Primary Examiner* — Jack W Lavinder
(74) *Attorney, Agent, or Firm* — Sughrue Mion, PLLC

(57) ABSTRACT

A clasp for a bracelet having first and second free ends, the clasp including: a device for adjusting the useful length of the bracelet including an adjusting member carrying a first bracelet fastening member, and a lock having a default closed state, in which the adjusting member is fixed, and an open state, in which the adjusting member is free to slide with respect to a second bracelet fastening member to modify the useful length of the bracelet. The adjusting device is distinct from the locking member, and the lock is arranged to change from the closed state to the open state thereof by action of the user such that the adjusting member is shifted independently of the open or closed state of the clasp. The control member includes a push-piece displaceable in response to an action of the user, the push-piece being independent of the lock.

16 Claims, 9 Drawing Sheets

(56) References Cited

U.S. PATENT DOCUMENTS

| | | | | |
|---|---|---|---|---|
| 3,863,299 | A * | 2/1975 | Hocq | A44C 5/24<br>24/71 J |
| 5,787,554 | A * | 8/1998 | Hashimoto | A44C 5/185<br>24/265 WS |
| 6,944,916 | B2 * | 9/2005 | Kawagoe | A44C 5/185<br>24/265 WS |
| 9,314,073 | B2 * | 4/2016 | Kaltenrieder | A44C 5/246 |
| 2014/0150495 | A1 * | 6/2014 | Kaltenrieder | A44C 5/14<br>63/3.2 |

FOREIGN PATENT DOCUMENTS

| | | |
|---|---|---|
| EP | 0 913 106 A1 | 10/1998 |
| EP | 1 378 185 A1 | 3/2002 |

* cited by examiner

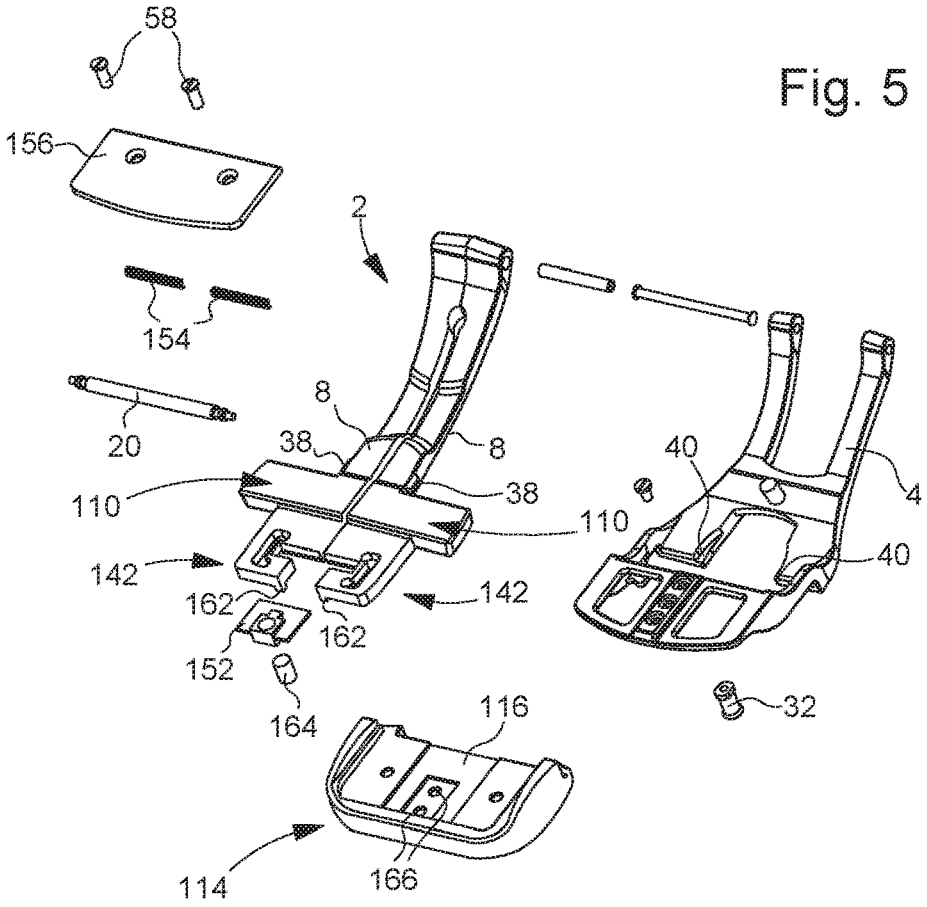
Fig. 5
Fig. 6
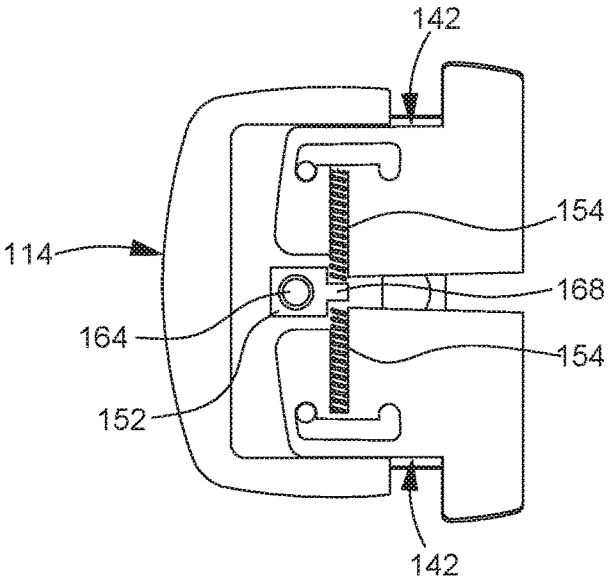

BRACELET CLASP COMPRISING A DEVICE FOR ADJUSTING THE USEFUL LENGTH OF THE BRACELET

This application claims priority from European Patent Application No. 13199618.3 filed 26 Dec. 2013 the entire disclosure of which is incorporated herein by reference.

FIELD OF THE INVENTION

The present invention relates to a clasp for a bracelet of the type comprising first and second free ends, wherein the clasp comprises:

first and second members for fastening the bracelet intended to be made respectively integral with the first and second free ends of the bracelet, wherein the fastening members are movable in relation to one another between at least one open position and a closed wearing position, in which they are closer to one another than in the open position, in order to close the bracelet and determine a useful length for it. The clasp comprises at least one locking member arranged to hold the bracelet fastening members in their closed position and at least one control member for the locking member arranged to unlock the clasp in response to an action of a user and to move from the closed position to the open position. In addition, the clasp according to the invention comprises a device for adjusting the useful length of the bracelet comprising:

an adjusting member, bearing the first bracelet fastening member and at least one lock capable of having a default closed state, in which the adjusting member is fixed, and an open state, in which the adjusting member is free to slide in the direction of the length of the bracelet, relative to the second bracelet fastening member, to modify the useful length of the bracelet.

The present invention also relates to a wristwatch fitted with such a clasp.

BACKGROUND OF THE INVENTION

There are well known issues as regards the necessity of providing a device for adjusting the useful length of a bracelet.

On the one hand, in the case of bracelets formed of links, the value of the user's wrist circumference may fall between two configurations of the bracelet separated from each other by a single link. This is also the case when a bracelet made of leather, rubber or the like has perforations that do not allow for a sufficiently fine adjustment. Similarly, it is useful to provide a device for adjusting the useful length of the bracelet that will allow for a finer adjustment of the bracelet length than the removal or addition of a link.

Further, it is also known that the value of the wrist circumference varies with the season, with the maximum value generally being attained in summer and the minimum value being attained in winter. Here too, it is preferable to provide a fine adjustment device for the useful length of the bracelet that enables the person wearing the bracelet to adjust the length to improve the wear comfort of the bracelet.

By way of example, EP Patent Application No 0913106 A1 discloses a clasp with a buckle of the unfolding type comprising a cover with a series of pairs of holes intended to accommodate the ends of a bar for attaching a bracelet. Two adjacent pairs of holes are separated by a distance defining one adjustment step of the useful bracelet length, to answer the aforementioned problems.

However, adjustment of the length of the corresponding bracelet is difficult because it cannot be performed without using a pointed tool. Not only does this operation require a certain dexterity, but it also risks causing damage to the cover if the person performing the adjustment is clumsy.

To avoid this situation, alternative devices have already been disclosed, such as for example in EP Patent No 0350785 B1 which discloses a similar clasp to the above but comprising, by way of alternative, a device for adjusting the useful length of the bracelet that can be operated without using a tool. Indeed, the clasp disclosed in that Patent is of the type with an unfolding buckle comprising two strips hinged to each other by means of a pin that passes through both, each of the strips carrying at the free end thereof a member for fastening a bracelet. A first strip bears a hook intended to be engaged in a hole arranged in the second strip to cooperate therein with a spring catch that enables the hook, and thus the clasp, to be locked in a closed state. The second strip comprises two parts that are slidable in relation to one another within a certain predefined range, defining an adjustment step of the useful length of the bracelet. A first of these two parts bears the hinge connecting it to the first strip, while the second part bears the locking spring catch. The hole in which the hook engages to lock the clasp has a length, in the longitudinal direction of the bracelet, which equates to the sliding range between the two parts of the second strip. The spring catch has a central part defining two positions for the hook in the longitudinal direction of the bracelet that correspond to two different useful lengths of the bracelet. A control member comprising, in particular, a push-piece allows actuation of the spring catch to release the hook and open the clasp.

Thus, the clasp described in this Patent has to be open in order to proceed with the length adjustment.

It may be pointed out that a resulting drawback thereof is that the adjustment of the bracelet length is lost each time the clasp is opened. Consequently, each time the clasp is closed, the wearer of the bracelet has to check that the hook is inserted on the side of the central spring catch part matching the desired bracelet length.

Adjustment devices comprising a specific locking member have also been proposed, by way of alternative, to avoid this type of drawback.

EP Patent Application No 1378185 A1 provides an example thereof. However, these devices generally have complex and not very discrete structures since they can comprise at least one control member associated with the locking of the clasp and at least one additional control member associated with the locking of the adjusting device.

DISCLOSURE OF THE INVENTION

It is a main object of the present invention to overcome the drawbacks of known prior art clasps, by proposing a bracelet clasp including a device for adjusting the useful length of a bracelet which has a simple structure, preferably proposes stable adjustment, including when the clasp is open, and which is easy to operate.

To this end, the present invention concerns a clasp for a bracelet of the type including first and second free ends, the clasp including:

first and second bracelet fastening members intended to be made respectively integral with the first and second free ends of the bracelet, wherein said fastening members are movable in relation to one another between at least one open position and a closed wearing position, in which they are closer to one another than in the open position, in order to close the bracelet and define a useful length therefore, at least one locking member arranged to hold said bracelet fastening members in their closed position, at least one control member for said locking member arranged to unlock the clasp in response to an action of a user and to move from said closed position to said open position, a device for adjusting the useful length of the bracelet comprising:

an adjusting member, bearing said first bracelet fastening member, and at least one lock capable of having a default closed state, in which said adjusting member is fixed, and an open state, in which said adjusting member is free to slide in the direction of the length of the bracelet relative to said second bracelet fastening member, in order to modify the useful length of the bracelet, said adjusting device being separate from said locking member and said lock being arranged to move from its closed state to its open state by the user acting on said control member of the locking member, such that said adjusting member is capable of being shifted independently of the open or closed state of the clasp, said control member comprises a push-piece capable of being moved in a substantially perpendicular direction to the longitudinal direction of the bracelet in response to an action of the user, said push-piece being independent of said lock.

As a result of these features, the adjusting device according to the invention has a discrete structure, since it is actuated by the control member already provided for unlocking the clasp, although it is separate from the locking member of the clasp, which additionally makes it possible to adjust the length of the bracelet even when the clasp is in its closed state.

In general, it can be advantageously provided that the unlocking of the clasp is associated with a displacement of the control member of a first amplitude d1, and the unlocking of the adjusting member by the lock is associated with a displacement of the control member of a second amplitude d2, wherein d1 is less than d2.

Thus, it is possible to unlock the clasp without unlocking the adjusting member, which guarantees that the desired adjustment is maintained during opening of the clasp, in contrast to the clasp of the prior art described above.

Moreover, the adjusting member preferably comprises a support structure carrying the first bracelet fastening member and at least one finger arranged to cooperate with the lock, the latter comprising a plate, which is adjacent to the support structure and in which a slot is provided in the longitudinal direction of the bracelet. The slot has at least two notches capable of cooperating with the finger in the closed state of the lock to define two different respective useful lengths of the bracelet, whereas the finger is capable of sliding into the slot in the open state of the lock to pass from one notch to the other and modify the useful length of the bracelet.

According to a preferred variant, the support structure comprises upper and lower walls, between which the plate is arranged, the finger taking the form of a screw securing the upper and lower walls to one another.

It can be additionally provided that the upper wall is formed by a cover comprising an upper surface bearing side walls having two holes intended to accommodate the ends of a fastening bar of a bracelet strand, and at least one support surface, against which the lower wall is held by means of the screw.

It can also be provided that the control member comprises a push-piece capable of being displaced in a substantially perpendicular direction to the longitudinal direction of the bracelet in response to an action of the user and that said push-piece is independent of said lock.

In general, it can be provided that the clasp has an additional control member, the control members being similar and symmetrical with respect to the longitudinal direction of the bracelet and that the adjusting device comprises an additional lock associated with the additional control member, the locks being similar and symmetrical with respect to the longitudinal direction of the bracelet, and an additional finger associated with the additional lock.

According to a preferred embodiment the clasp is of the deployment buckle type comprising at least two strips hinged to one another, of which a first strip comprises two posts, which are symmetrical with respect to the longitudinal direction of the bracelet, and inserted into a complementary recess of the second strip to place the clasp in its closed position by briefly bringing the posts closer against elastic return means, the outer side edge of each of the posts cooperating with the corresponding inside edge of the recess to define a locking member of the clasp. It can then advantageously be provided that each of said posts carries one of said locks, and that said push-pieces abut against the locks and are slidably engaged through corresponding apertures arranged in the side walls of the cover and in which they are retained by rims which extend on both sides of the push-pieces.

In general, it can also be provided that the adjusting device comprises at least one elastic member that exerts a force on the lock or locks tending to hold said lock(s) in the closed state.

In this case, the adjusting device preferably comprises an intermediate member whose position is fixed with respect to the lock and which has a support surface for one end of the elastic member.

The adjusting device can also comprise a ball click associated with at least two complementary openings arranged to index at least two configurations corresponding to two different useful lengths of the bracelet. The ball click can thus be carried by the intermediate member. In this case the openings can be arranged in the upper wall of the adjusting device.

BRIEF DESCRIPTION OF THE DRAWINGS

Other features and advantages of the present invention will become clearer upon reading the following detailed description of preferred embodiments with reference to the attached drawings given by way of non-limiting examples:

FIG. 5 is a partially exploded perspective view of a bracelet clasp when it is open.

FIG. 6 is a simplified cross-sectional view of a design detail of the clasp of FIG. 5.

EMBODIMENT OF THE INVENTION

Figure 7:
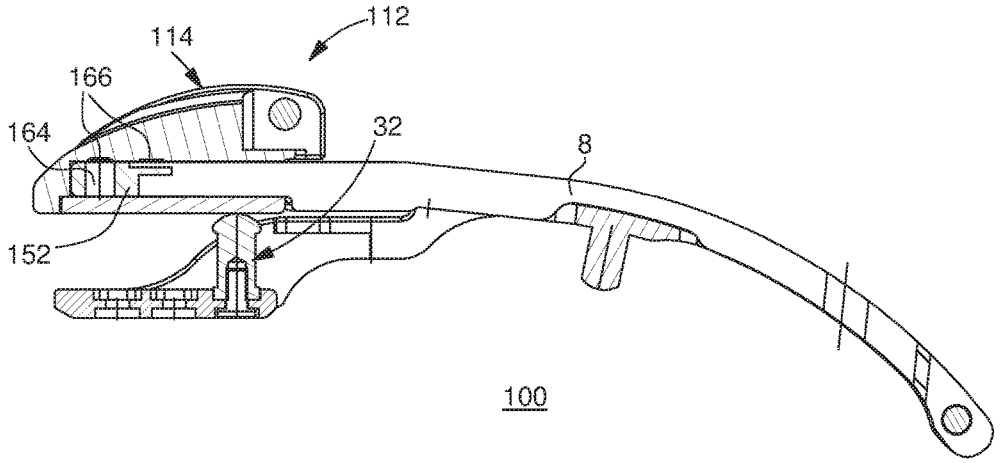
Fig. 7 PRIOR ART
FIG. 7 is a longitudinal cross-sectional view of the clasp of FIG. 5.
Figure 8:
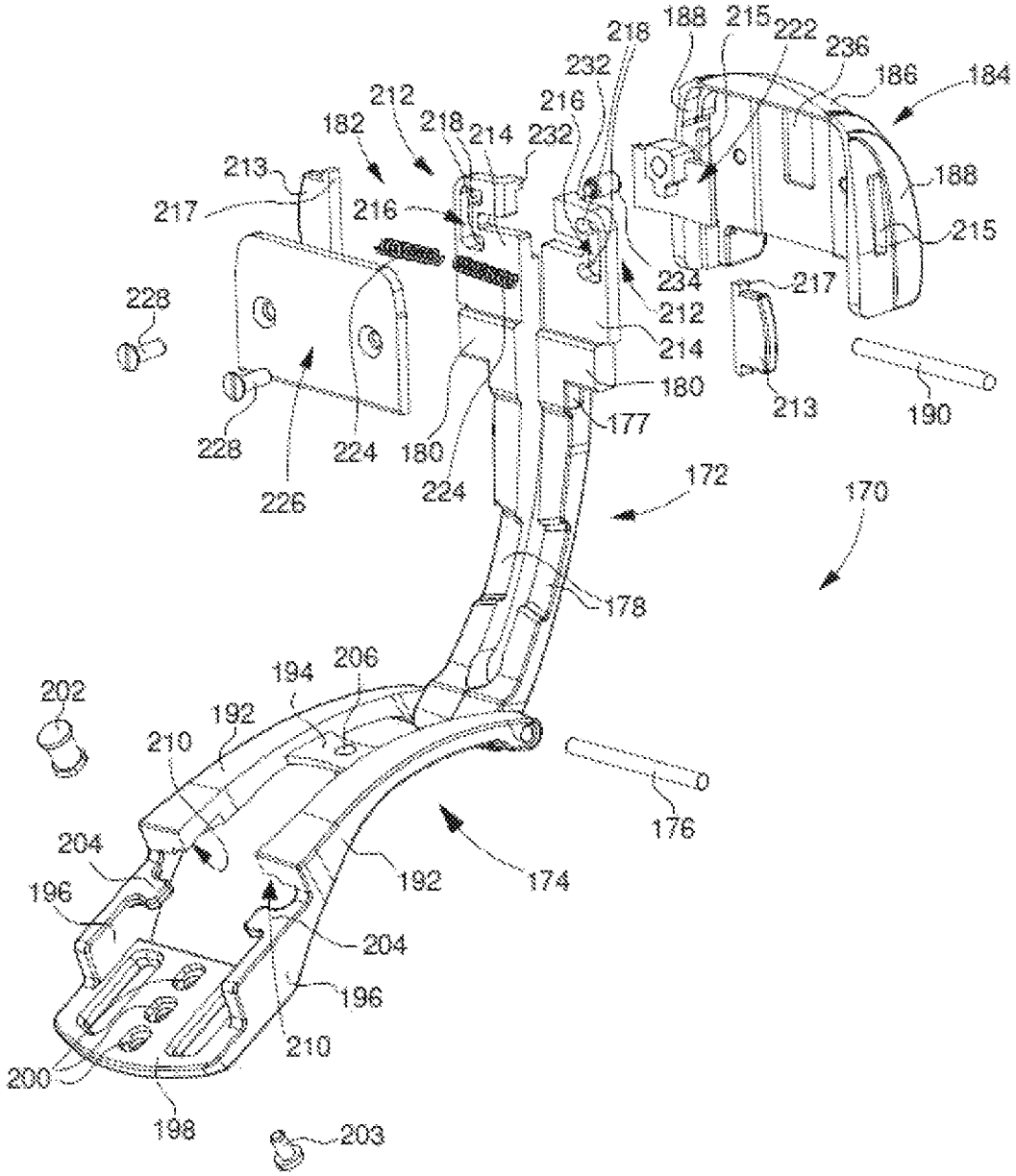
FIG. 8 is an exploded perspective view along the inner side of a second variant embodiment of a clasp according to the invention when it is open.

The clasp illustrated by way of non-limiting example in the FIGS. 7 and 8 corresponds to a preferred embodiment of the present invention. More specifically, the clasp 170 is of the deployment buckle type and is intended to fasten a timepiece bracelet.

Figure 1:
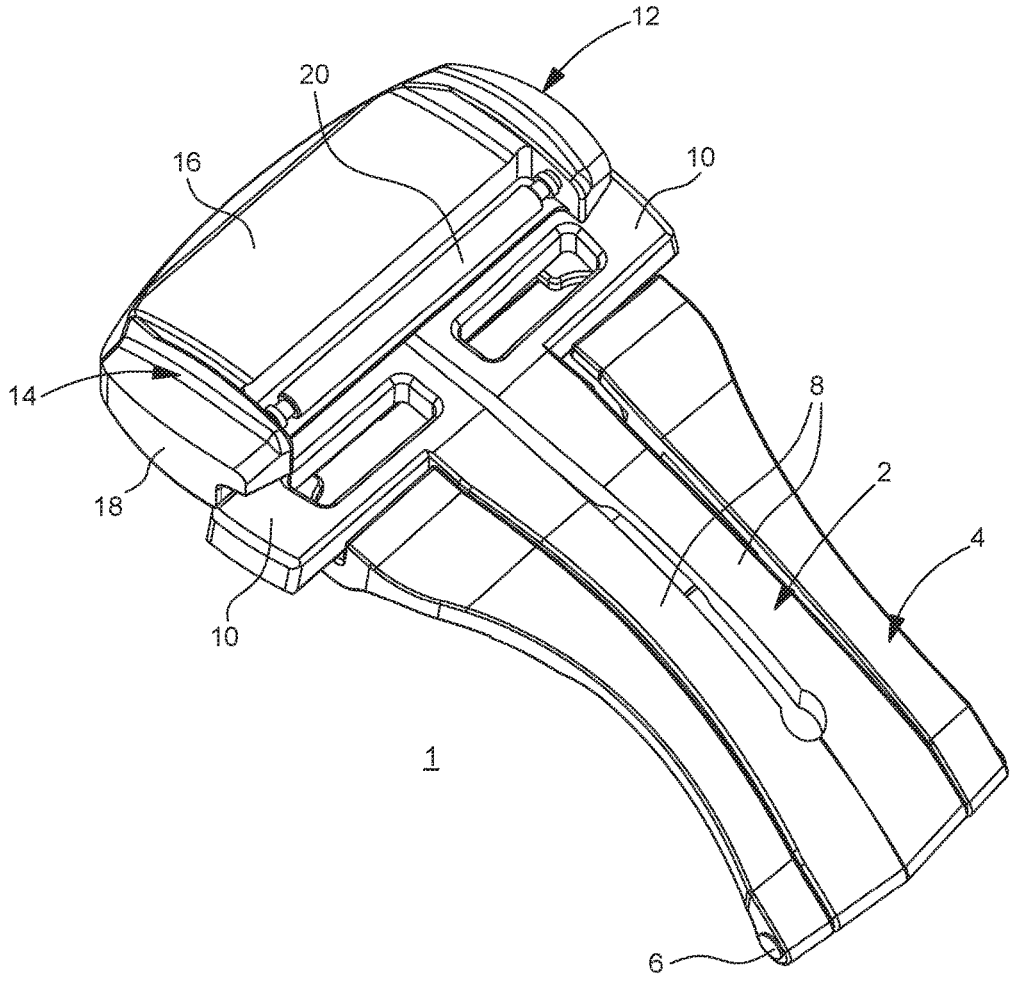
Fig. 1 PRIOR ART
FIG. 1 is a simplified general perspective view of a bracelet clasp when it is closed.

As is evident more specifically in FIG. 1, clasp 1 comprises a first strip 2 hinged to a second strip 4 by means of a pin 6, consisting here of a rod riveted to strip 4 in an illustrative but non-limiting manner. Each of the strips has an elongated shape in the longitudinal direction of the bracelet and is slightly curved to better match the shape of the wrist of a wearer.

First strip 2 includes two posts 8 arranged in contact with each other at the respective end thereof located on the side of pin 6, and each having a cut out portion so that said posts are not in contact with each other over most of the length thereof.

Figure 2:
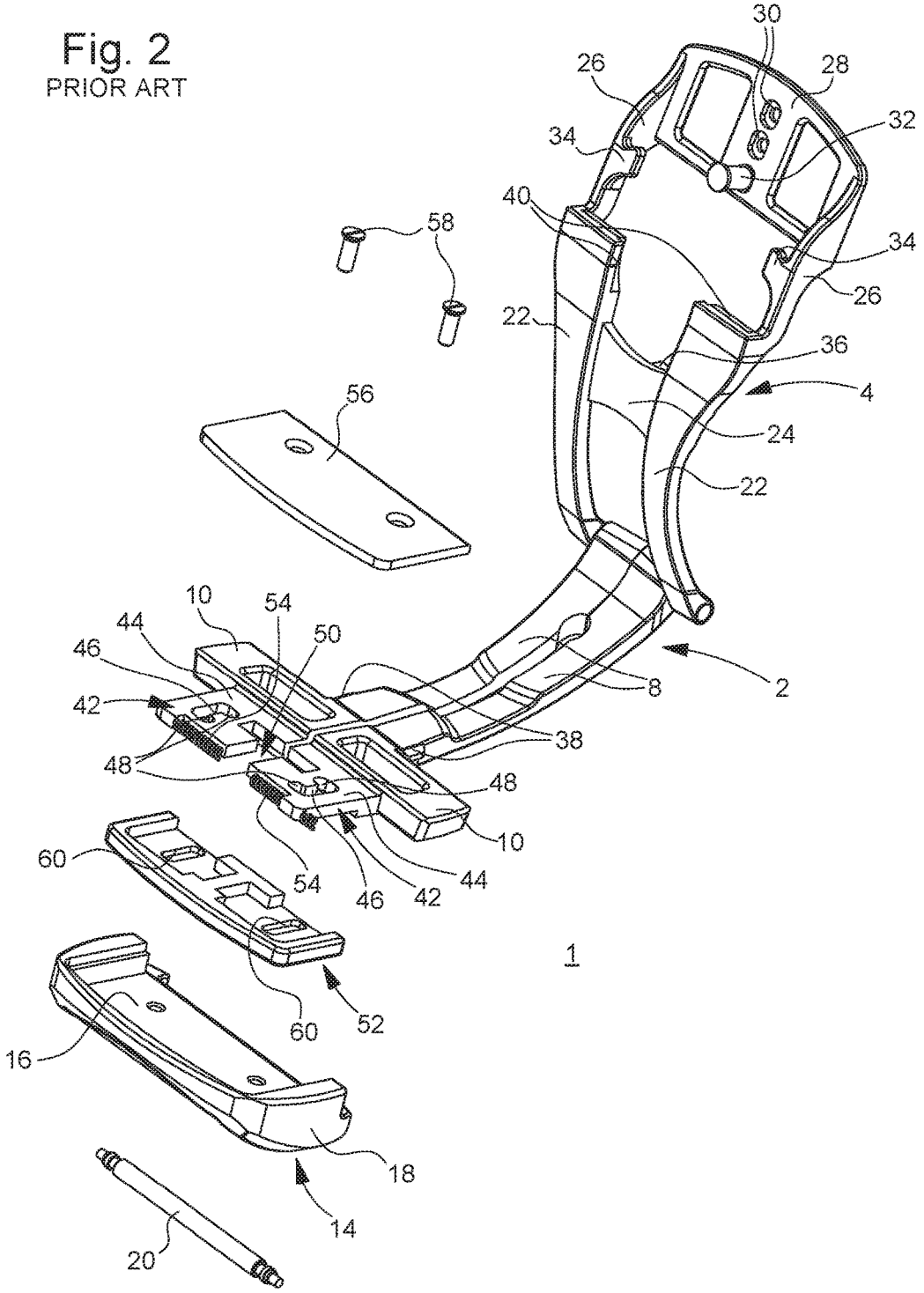
Fig. 2 PRIOR ART
FIG. 2 is a partially exploded perspective view of the clasp of FIG. 1 when it is open.

Each of posts 8 has an extension 10 in proximity to the end thereof remote from pin 6, extending in a direction perpendicular to the longitudinal direction of the bracelet to form a push-piece that defines a control member allowing the clasp to be unlocked, as will be seen from the detailed description of FIG. 2.

Further, the free end of first strip 2 carries a device 12 for adjusting the useful length of the bracelet, intended to be associated with clasp 1.

Adjustment device 12 includes a cover 14 having an upper wall 16 carrying lateral walls 18. The lateral walls 18 are provided with two holes for housing one end of a bar 20 securing a bracelet strand, in a conventional manner.

FIG. 2 shows an exploded perspective view of clasp 1 when it is open.

It is evident from FIG. 2 that the second strip 4 comprises two arms 22 joined by a transverse post 24 in their central area. Arms 22 are extended by bent portions 26 carrying a plate 28 for securing a bracelet strand, shifted relative to the general direction of arms 22 to define a recess for the bracelet strand.

Securing plate 28 has a plurality of holes 30, regularly spaced apart from each other and allowing the insertion of a round headed foot screw 32, intended to be engaged in a hole in the bracelet, in order to secure the bracelet to the clasp, a screw (not visible) being screwed into foot screw 32. Each bent portion 26 also has a small tongue 34 for improving the hold of the bracelet strand once it is positioned on clasp 1. The transverse post 24 carries an optional nail 36 or a screw, intended to be engaged in another hole in the bracelet to further improve the hold thereof on the clasp. Screw 32 may be placed in one hole 30 or another to define a space, between said screw and nail 36, corresponding to an integer number of hole pitches arranged in the bracelet strand.

The space between arms 22 of second strip 4 defines a recess allowing first strip 2 to be accommodated in the closed state of clasp 1 in a known manner.

Conventional locking means are provided to hold the clasp in the closed state. The outer edges of posts 8 have thickened portions 38 in proximity to push-pieces 10, intended to cooperate with the inner edges of second strip 4, at the recess, by friction. In particular, each inner edge of the second strip has a hollow 40, in which the corresponding thickened portion of first strip 2 is engaged when the clasp is closed. The cut-out made in each of posts 8 clears a space allowing them to come closer to one another against elastic return means during the locking of the clasp or when push-pieces 10 are actuated to release thickened portions 38 from hollows 40 to open the clasp.

EP Patent Application No 0913106 A1 mentioned above describes a clasp of this type in detail and those skilled in the art may refer thereto if necessary.

Each push-piece 10 is extended by a lock 42 of the device for adjusting the useful length of the bracelet.

Each lock 42 includes a plate 44 having a slot 46 oriented in the longitudinal direction of the bracelet and having two notches 48 at the ends thereof.

The locks are shaped to define between them a T-shaped recess 50 which is intended to cooperate with and hold an intermediate member 52 relative to locks 42.

A first function of intermediate member 52 is to provide support surfaces for a first end of springs 54, whose second end abuts against the corresponding plate 44, these springs being arranged to hold locks 42 in their closed state, as will be seen below in the detailed description of FIGS. 3 and 4.

A second function of the intermediate member is to act as a cross-piece to improve the structural stability of the adjusting device.

Indeed, it is clear from FIG. 2 that the support structure of the adjustment device includes a lower wall 56 secured to upper wall 16 of cover 14 by means of two screws 58. Also, upper wall 16 and intermediate member 52 have respective bearing surfaces against which lower wall 56 is arranged, thereby improving the stability of the resulting assembly.

Screws 58 are disposed through slots 46 and also through appropriate slots 60 arranged in intermediate member 52.

Locks 42 are thus arranged between the lower wall 56 and upper wall 16, confined there by the cooperation of slots 46 with screws 58.

The method of operation of the adjusting device according to the present invention will now be explained with reference to FIGS. 3 and 4, which show similar simplified cross-sectional views of the adjusting device along a middle plane in first and second configurations respectively.

Figure 3:
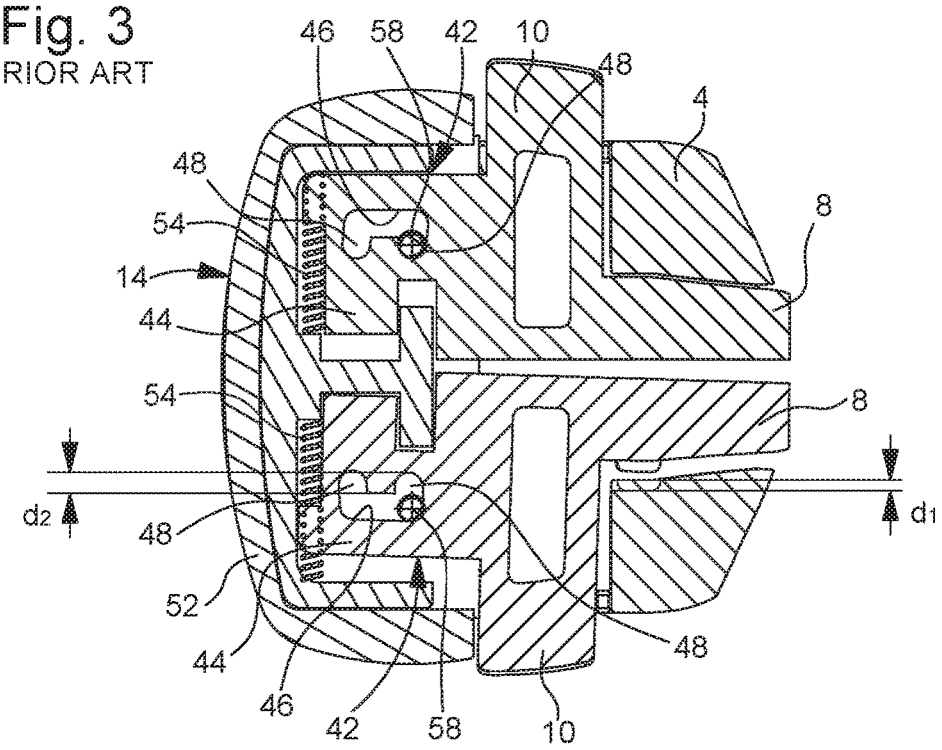
Fig. 3 PRIOR ART
FIG. 3 is a simplified cross-sectional view of a design detail of the clasp of FIG. 1 in a first configuration.
Figure 4:
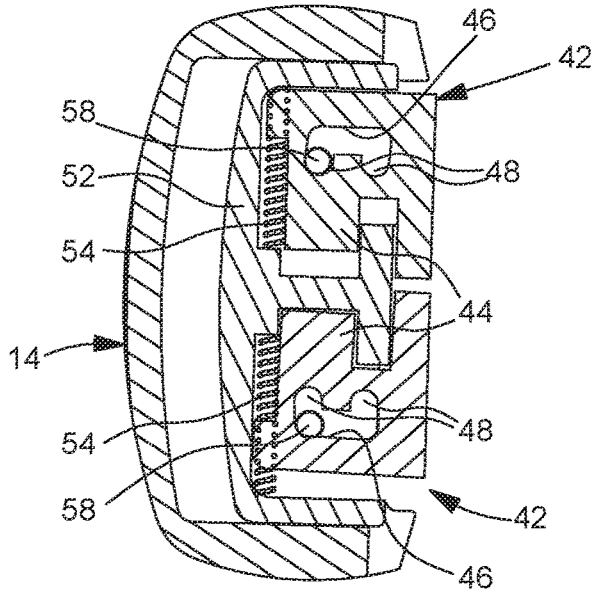
Fig. 4 PRIOR ART
FIG. 4 is a similar view to that of FIG. 3 in a second configuration of the clasp.

More specifically, FIG. 3 corresponds to the long configuration of the clasp, i.e. the configuration in which the useful length of the bracelet is the longest, while FIG. 4 corresponds to its short configuration, i.e. the configuration in which the useful length of the bracelet is the shortest.

In each of these Figures the upper half illustrates a first lock 42 in its closed state, while the lower half illustrates the second lock 42 in its open state.

When push-pieces 10 are free, the shape of posts 8 at rest assisted by the action of springs 54 holds each lock 42 in a separated position corresponding to the closed state.

In this configuration, each of screws 58 is located in one of notches 48 and the support structure cannot move in the longitudinal direction of the bracelet with respect to locks 42.

When push-pieces 10 are actuated, locks 42 move closer to one another to change into their open state (lower halves of FIGS. 3 and 4).

Notches 48 shift during this operation, and screws 58 are consequently located in the axis of slots 46 and are thus capable of sliding along the slots to position themselves opposite one notch 48 or another, as required. Thus, when a user actuates push-pieces 10 to bring locks 42 in the open state, he can then operate cover 14 and move it along the longitudinal direction of the bracelet to change the useful length thereof. When screws 58 are again opposite one of notches 48, posts 8 return to the rest shape, if there is no action by the user on push-pieces 10, via elasticity and the simultaneous action of springs 54. This action entails the return of locks 42 to the closed state and thus locks the adjustment member, which includes cover 16 associated with lower wall 56 and screws 58.

Comparing FIGS. 3 and 4, it is evident that in the configuration of FIG. 3, assuming that a bracelet is assembled to clasp 1, the length of the superposed portions of the bracelet strands is smaller than this length in the configuration of FIG. 4, which means that the configuration of FIG. 3 provides a longer useful bracelet length than the configuration of FIG. 4.

Further, it is clear from a comparison of the upper and lower halves of FIG. 3 that a first amplitude of deformation d1 of posts 8 makes it possible to unlock clasp 1, whereas a second amplitude of deformation d2 of posts 8, which is greater than first amplitude d1, is necessary to release screws 58 and allow them to slide in slots 56. Thus, it is possible, in a preferred manner, for the design to allow clasp 1 to be opened without modifying the adjustment made by the adjustment device.

Moreover, this particular feature also allows the length of the clasp to be adjusted when said clasp is open and also advantageously allows this adjustment to be maintained.

FIGS. 5 to 7 illustrate a variant of the clasp that has just been described. To simplify the present explanation, identical elements to those of the embodiment that has been described are given the same reference numbers and only the features that differ will be described in detail.

FIG. 5 shows a clasp 100 in its closed configuration in an exploded perspective view, the general structure of this clasp being identical to that of clasp 1.

Clasp 100 differs from clasp 1 mainly in the structure of its device 112 for adjusting the useful length of the bracelet.

Adjusting device 112 comprises two locks 142 integral with posts 108 of the first strip 102 of clasp 100, push-pieces 110 also being provided both for opening the clasp and for changing locks 142 from their closed state to their open state.

An intermediate member 152 is arranged between the lower 156 and upper 116 walls of the adjusting device and held in the longitudinal direction of the bracelet by a thickened portion 162 arranged on each of locks 142.

In addition to the functions already described in relation to intermediate member 52, the intermediate member 152 bears a ball click 164 intended to assure indexation of the different possible adjustment configurations.

It is also evident from FIG. 5 that upper wall 116 is provided with openings 166 intended to cooperate with the ball of ball click 164.

The arrangement of the adjusting device 112 is more clearly visible in FIG. 6, which shows a cross-sectional view of the device along a middle plane.

Intermediate member 152 has a small tongue 168 defining two bearing surfaces for the first ends of springs 154 acting on locks 142 to hold said locks in the closed state.

FIG. 7 shows clasp 100 in a longitudinal cross-section and can thus better illustrate how ball click 164 cooperates with upper wall 116 of cover 114 to index the different possible adjustment positions of clasp 100.

Clasp 100 is shown in its long configuration in FIG. 7. It is clear from the above explanations that if cover 114 is moved towards the left of the Figure, the bracelet (not shown) is shortened.

Figure 9:
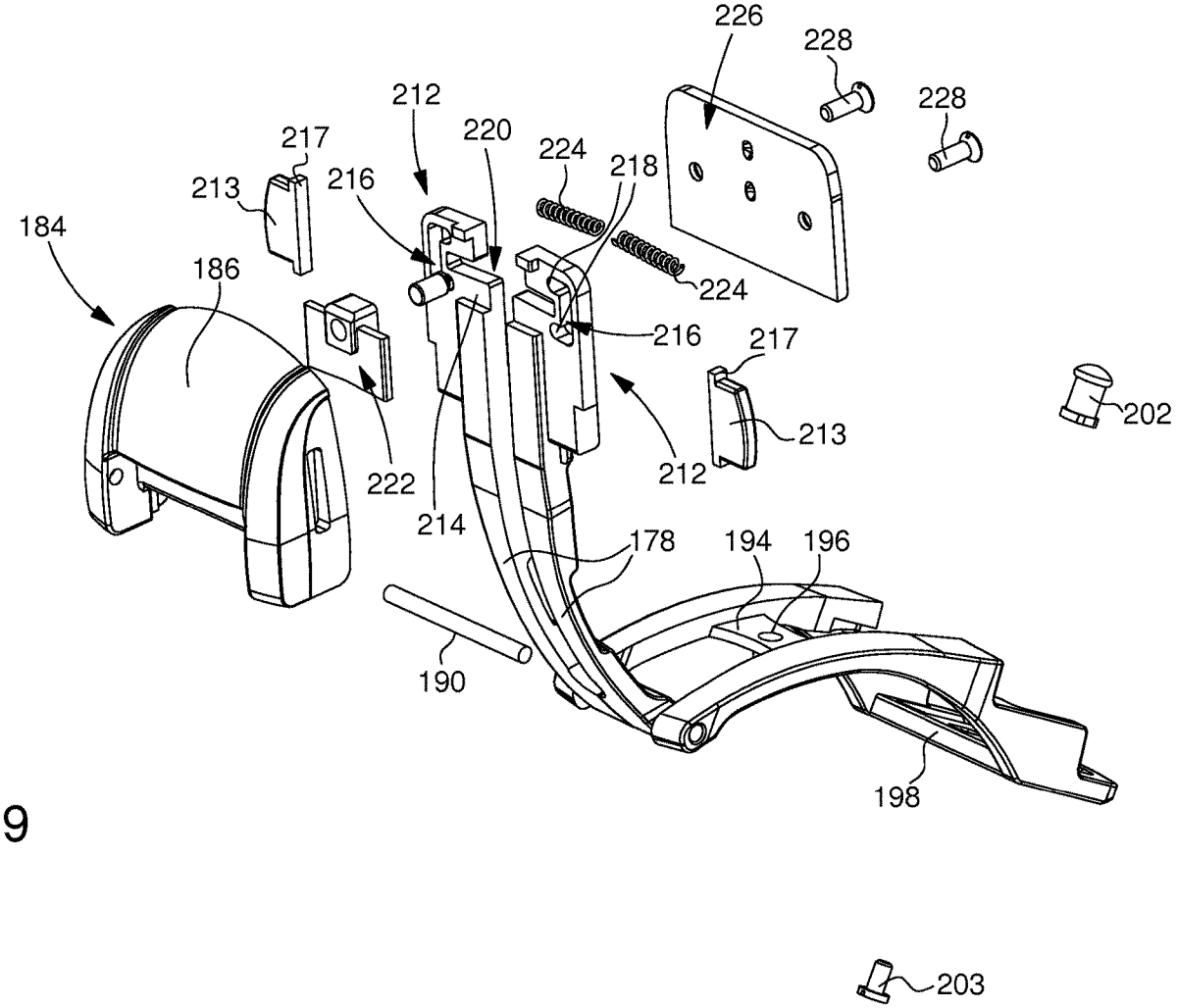
FIG. 9 is a similar view to that of FIG. 8 of the outer side of the clasp.

Another variant embodiment of a clasp of the invention is shown in FIGS. 8 and 9. Designated as a whole by the general reference numeral 170, the clasp includes a first strip 172 hinged on a second strip 174 by means of a pin 176. Each of strips 172, 174 has an elongated shape in the longitudinal direction of the bracelet and is slightly curved to better match the shape of the wrist of a wearer.

First strip 172 includes two posts 178 having a cut-out portion so that they are only in contact with one another at the end thereof located on the side of pin 176.

Each of posts 178 carries, in proximity to the end thereof remote from pin 176, an extension 180 defining a control member for unlocking the clasp as described in detail below.

In addition, the free end of the first strip 172 bears a device 182 for adjusting the useful length of the bracelet intended to be associated with clasp 170. Adjustment device 182 includes a cover 184 having an upper wall 186 carrying lateral walls 188. The lateral walls 188 are provided with two holes for accommodating one end of a bar 190 for securing a bracelet strand, in a conventional manner.

It is evident from FIGS. 8 and 9 that the second strip 174 comprises two arms 192 joined by a transverse post 194 in their central region. Arms 192 are extended by bent portions 196 carrying a plate 198 for securing a bracelet strand, shifted relative to the general direction of arms 192 to define a recess for the bracelet strand.

Securing plate 198 has a plurality of holes 200, regularly spaced apart from each other and allowing insertion of a round headed foot screw 202, intended to be engaged in a hole in the bracelet, in order to secure the bracelet to clasp, with a screw 203 screwed into foot screw 202. Each bent portion 196 also has a small tongue 204 for improving the hold of the bracelet strand once it is positioned on clasp 170. The transverse post 194 carries an additional, optional screw or nail 206, intended to be engaged in another hole in the bracelet to further improve the hold thereof on the clasp. Foot screw 202 may be placed in one hole 200 or another to define a space, between said foot screw and nail 206, which corresponds to an integer number of hole pitches arranged in the bracelet strand.

The space between the arms 192 of the second strip 174 defines a recess for accommodating first strip 172 in the closed state of clasp 1.

Each extension 180 is extended by a lock 212 of the device for adjusting the useful length of the bracelet.

Each lock 212 includes a plate 214 having a slot 216 oriented in the longitudinal direction of the bracelet and having two notches 218 at the ends thereof.

Adjusting device 182 comprises two locks 212 integral with posts 178 of the first strip 172 of clasp 170, push-pieces 213 also being provided both for opening the clasp and for changing locks 212 from their closed state to their open state. These push-pieces 213, which abut against locks 212, are slidably engaged through corresponding apertures 215 arranged in the lateral walls 188 of cover 184 and in which they are retained by rims 217 which extend on both sides of push-pieces 213. In the closed position of clasp 170, thickened portions 177 of posts 178 are in mesh with the inner edges of second strip 174 so as to maintain the closed state of clasp 170. In particular, each inner edge of second strip 174 has a hollow 210, in which the corresponding thickened portions 177 of posts 178 are engaged when clasp 170 is closed. When push-pieces 213 are actuated by the user towards each other, thickened portions 177 of posts 178 are released from hollows 210, which allows clasp 170 to be opened. The cut-out portion made in each of posts 178 leaves a space allowing them to move closer together against the elastic return force of springs 224 during the locking of clasp 170 or when push-pieces 213 are actuated to release thickened portions 177 of posts 178 from hollows 210 to open clasp 170.

An intermediate member 222 is arranged between the lower 226 and upper 186 walls of the adjusting device and held in the longitudinal direction of the bracelet by a thickened portion 232 arranged on each of locks 212.

Intermediate member 222 carries a ball click 234 for indexing the various possible adjustment configurations.

It is also evident from FIGS. 8 and 9 that the upper wall 186 is provided with openings 236 intended to cooperate with the ball of ball click 234.

Figure 10:
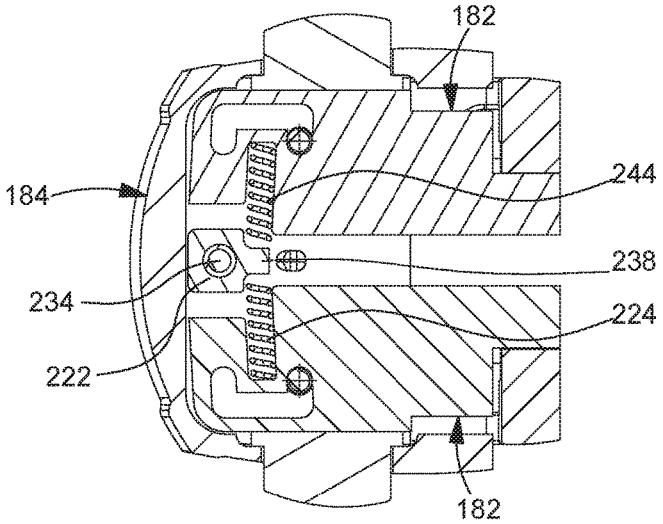
FIG. 10 is a simplified cross-sectional view of a design detail of the clasp of FIGS. 8 and 9.

The arrangement of the adjusting device 182 is more clearly visible in FIG. 10, which shows a cross-sectional view of the device along a middle plane.

Intermediate member 222 has a small tongue 238 defining two bearing surfaces for the first ends of springs 224 acting on locks 212 to hold said locks in the closed state.

Figure 11:
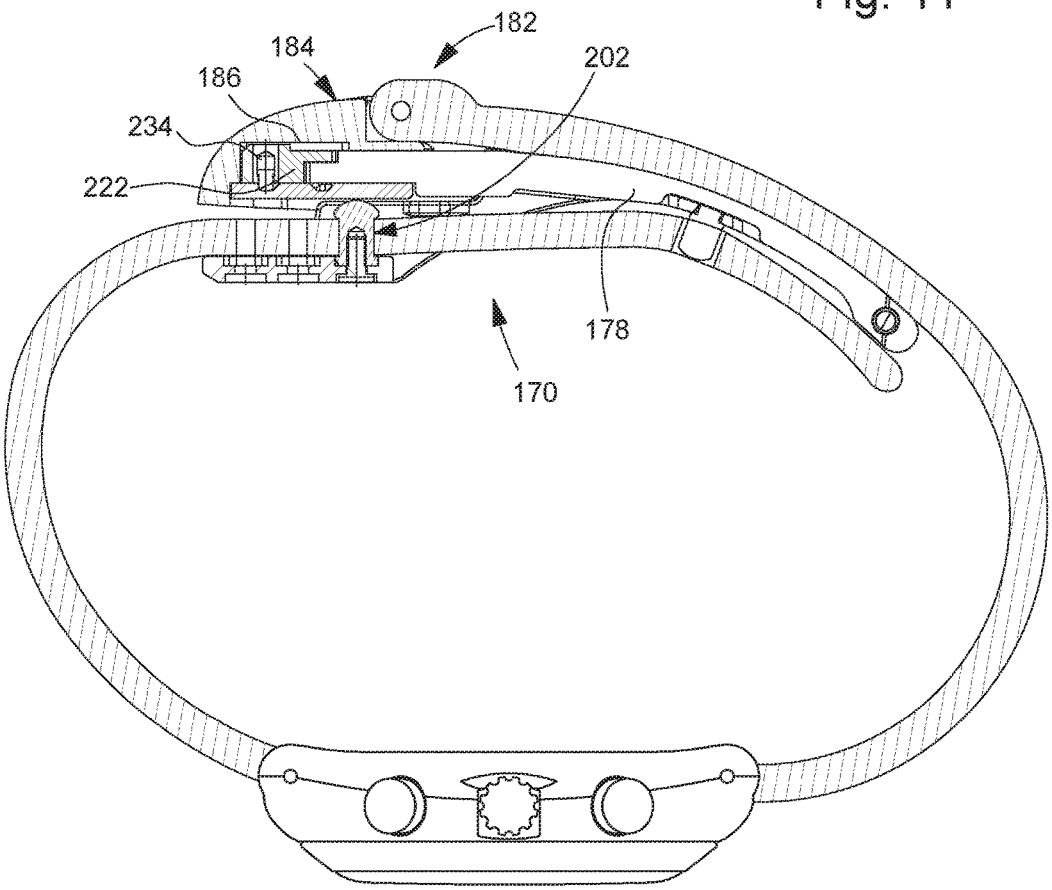
FIG. 11 is a longitudinal cross-sectional view of the clasp of FIGS. 8 and 9.

FIG. 11 shows clasp 170 in longitudinal cross-section and can thus better illustrate how ball click 234 cooperates with upper wall 186 of cover 184 to index the different possible adjustment positions of clasp 170.

Clasp 170 is shown in its long configuration in FIG. 10. It is clear from the above explanations that if cover 184 is moved towards the left of the Figure, the bracelet (not shown) is shortened.

Locks 212 are shaped to define between them a T-shaped recess which is intended to cooperate with and to hold an intermediate member 222 relative to locks 212.

The first function of intermediate member 222 is to provide support surfaces for a first end of springs 224, whose second end abuts against the corresponding plate 214, these springs 224 being arranged to hold locks 42 in the closed state.

A second function of intermediate member 222 is to act as a cross-piece to improve the structural stability of the adjusting device.

Indeed, it is clear from FIGS. 8 and 9 that the support structure of the adjustment device includes a lower wall 226 secured to upper wall 186 of cover 184 by means of two screws 228. Also, upper wall 186 and intermediate member 222 have respective bearing surfaces against which lower wall 226 is arranged, thereby improving the stability of the resulting assembly.

Screws 228 are arranged through slots 216. Locks 212 are thus arranged between lower wall 226 and upper wall 186, confined there by the cooperation of slots 216 with screws 228.

When push-pieces 213 are not actuated by the user, the shape of posts 178 at rest assisted by the action of springs 224 holds each lock 212 in a separated position corresponding to the closed state.

In this configuration, each of screws 228 is located in one of notches 218 and the support structure cannot move in the longitudinal direction of the bracelet with respect to locks 212.

When push-pieces 213 are actuated by the user, locks 212 move towards each other to change into the open state. Notches 218 shift during this operation, and screws 228 are consequently located in the axis of slots 216 and are thus capable of sliding along the slots to position themselves opposite one notch 218 or another, as required. Thus, when a user actuates push-pieces 213 to place locks 42 in the open state, he can then operate cover 184 and move it along the longitudinal direction of the bracelet to change the useful length thereof. When screws 228 are again opposite one of notches 218, posts 178 return to the rest shape, if there is no action by the user on push-pieces 213, via elasticity and the simultaneous action of springs 224. This action entails the return of locks 212 to the closed state and thus locks the adjustment member, which includes cover 186 associated with lower wall 226 and screws 228.

The method of operation of the adjusting device according to the present invention will now be explained with reference to FIGS. 12 and 13, which show similar simplified cross-sectional views of the adjusting device along a middle plane in first and second configurations respectively.

Figure 12:
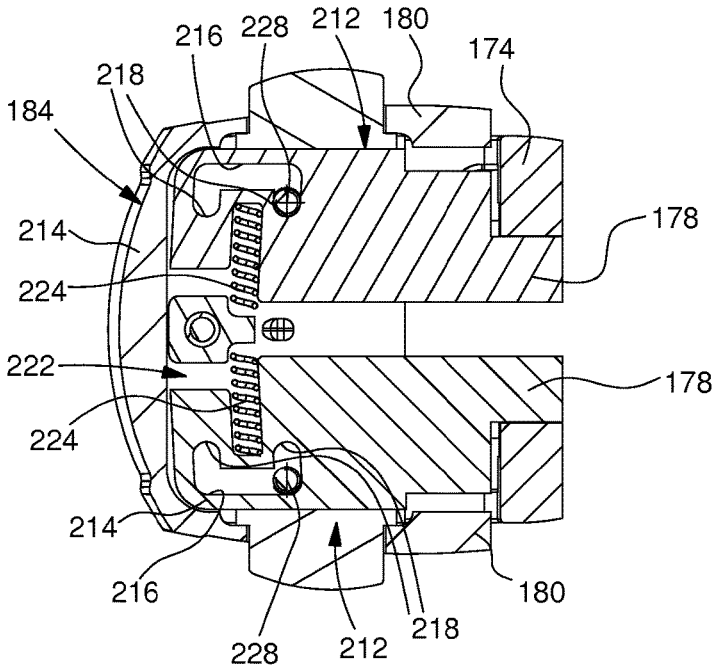
FIG. 12 is a simplified cross-sectional view of a design detail of the clasp of FIG. 8 in a first configuration.
Figure 13:
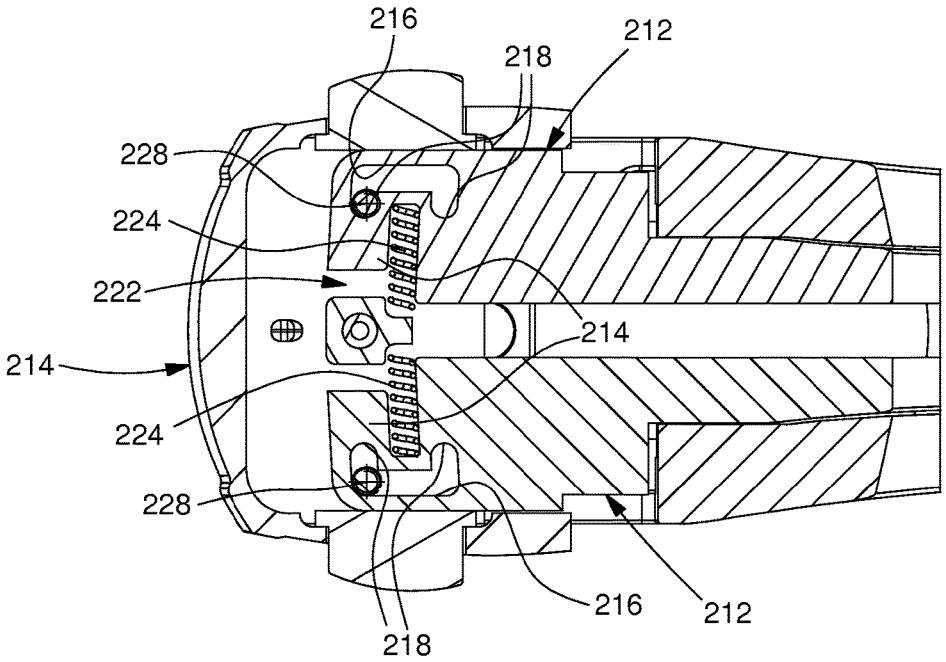
FIG. 13 is a similar view to that of FIG. 12 in a second configuration of the clasp.

More specifically, FIG. 12 corresponds to the long configuration of the clasp, i.e. the configuration in which the useful length of the bracelet is the longest, while FIG. 13 corresponds to its short configuration, i.e. the configuration in which the useful length of the bracelet is the shortest.

In each of these figures the upper half illustrates a first lock 212 in its closed state, while the lower half illustrates the second lock 212 in its open state.

When extensions 180 are free, the shape of posts 178 at rest, assisted by the action of springs 224 holds each lock 212 in a separated position corresponding to the closed state.

In this configuration, each of screws 228 is located in one of notches 218 and the support structure cannot move in the longitudinal direction of the bracelet with respect to locks 212.

When push-pieces 213 are actuated, locks 212 move closer to one another to change into their open state (lower halves of FIGS. 12 and 13).

Notches 218 shift during this operation, and screws 228 are consequently located in the axis of slots 216 and are thus capable of sliding along the slots to position themselves opposite one notch 218 or another, as required. Thus, when a user actuates push-pieces 213 to place locks 212 in the open state, he can then operate cover 184 and move it along the longitudinal direction of the bracelet to change the useful length thereof. When screws 228 are again opposite one of notches 218, posts 178 return to the rest shape, if there is no action by the user on push-pieces 213, via elasticity and the simultaneous action of springs 224. This action entails the return of locks 212 to the closed state and thus locks the adjustment member, which includes cover 186 associated with lower wall 226 and screws 228.

Comparing FIGS. 12 and 13, it is evident that in the configuration of FIG. 12, assuming that a bracelet is assembled to clasp 170, the length of the superposed portions of the bracelet strands is smaller than this length in the configuration of FIG. 13, which means that the configuration of FIG. 12 provides a longer useful bracelet length than the configuration of FIG. 13.

Further, it is clear from a comparison of the upper and lower halves of FIG. 12 that a first amplitude of deformation d1 of posts 178 makes it possible to unlock clasp 170, whereas a second amplitude of deformation d2 of posts 178, which is greater than first amplitude d1, is necessary to release screws 228 and allow them to slide in slots 226. Thus, it is possible, in a preferred manner, for the design to allow clasp 170 to be opened without modifying the adjustment made by the adjustment device.

Moreover, this particular feature also allows the length of the clasp to be adjusted when said clasp is open and to then also advantageously maintain this adjustment.

The invention concerns a clasp for a bracelet of the type comprising first and second free ends, the clasp 170 comprising:

- first and second bracelet fastening members 172, 174 intended to be made respectively integral with the first and second free ends of the bracelet, said fastening members 172, 174 being movable in relation to one another between at least one open position and a closed wearing position, in which they are closer to one another than in the open position, to close the bracelet and define a useful length therefor,
- at least one locking member 210, 217 arranged to hold said bracelet fastening members 172, 174 in their closed position;
- at least one control member 180 for said locking member 210, 217 arranged to unlock the clasp 170 in response to an action of a user and to change from said closed position to said open position;
- a device 182 for adjusting the useful length of the bracelet comprising:
- an adjusting member 184, 186, 226, 228 carrying said first bracelet fastening member 172, and
- at least one lock 212 capable of having a default closed state, in which said adjusting member 184, 186, 226, 228 is fixed, and an open state, in which said adjusting member 184, 186, 226, 228 is free to slide in the direction of the length of the bracelet with respect to said second bracelet fastening member 174 to modify the useful length of the bracelet,
- said adjusting device 182 being distinct from said locking member 210, 217, and said lock 212 being arranged to change from its closed state to its open state by action of the user on said control member 180 of the locking member 210, 217 such that said adjusting member 184, 186, 226, 228 is capable of being shifted independently of the open or closed state of the clasp,
- said control member comprises a push-piece 213 capable of being displaced in a substantially perpendicular direction to the longitudinal direction of the bracelet in response to an action of the user, said lock 213 being independent of said push-piece 212.

Said adjusting member comprises a support structure 184 carrying said first bracelet fastening member 172 and at least one finger 228 arranged to cooperate with said lock 212, said lock comprises a plate 214, which is adjacent to said support structure 184 and in which a slot 216 is arranged in the longitudinal direction of the bracelet, said slot 216 having at least two notches 218 capable of cooperating with said finger 228 in the closed state of said lock 172 to define two different respective useful lengths of the bracelet, whereas said finger 228 is capable of sliding into said slot 216 in the open state of said lock 212 to pass from one notch 218 to the other and modify the useful length of the bracelet.

Said support structure 184 comprises upper 186 and lower 226 walls, between which said plate 214 is arranged, said finger 228 taking the form of a screw securing said upper and lower walls 186, 226 to one another.

Said upper wall 186 is formed by a cover 184 including an upper surface carrying lateral walls 188 having two holes intended to accommodate the ends of a bar 190 for securing a bracelet strand, and at least one support surface against which said lower wall 226 is held by means of said screw 228.

The clasp includes, on the one hand, an additional control member 180, said control members 180 being similar and symmetrical relative to the longitudinal direction of the bracelet, and on the other hand:

- an additional lock 212 associated with said additional control member 180, said locks 212 being similar and symmetrical relative to the longitudinal direction of the bracelet, and
- an additional finger 228 associated with said additional lock 212.

The clasp is of the type having an unfolding buckle and includes at least two strips 172, 174 hinged to each other, of which a first strip 172 includes two posts 178 which are symmetrical relative to the longitudinal direction of the bracelet, inserted in a substantially complementary recess of the second strip 174 to place the clasp in its closed position, by momentarily moving said posts 178 closer together against the force of elastic return means 224. Each of said posts 178 carries one of said locks 212, and said push-pieces 213, which abut against locks 212 and are slidably engaged through corresponding apertures 215 arranged in the lateral walls 188 of cover 184 and in which they are retained by rims 217 which extend on both sides of push-pieces 213.

In the closed position of clasp 170, the rims 217 of push-pieces 213 are in mesh with the inner edges of second strip 174 so as to maintain the closed state of clasp 170.

Each inner edge of second strip 174 has a hollow 210, in which the corresponding rims 217 of push-pieces 213 are engaged when clasp 170 is closed.

Said adjusting device 182 comprises at least one elastic member 224 exerting a force on said lock or locks 212 tending to hold the lock(s) in their closed state.

Said adjusting device 182 preferably comprises an intermediate member 222 whose position is fixed with respect to said lock 212 and which has a support surface for one end of said elastic member 224.

Said adjusting device 182 also comprises a ball click 234 associated with at least two substantially complementary openings 236 arranged to index at least two configurations of adjusting device 182 corresponding to two different useful lengths of the bracelet.

Said ball click 234 is carried by said intermediate member 222.

Said openings 236 are arranged in said upper wall 186 of said adjusting device 182.

The unlocking of the clasp is associated with a displacement of said control member 180 of a first amplitude d1, and the unlocking of said adjusting member 184, 186, 226, 228 by said lock 212 is associated with a displacement of said control member 180 of a second amplitude d2, wherein d1 is less than d2.

The invention also concerns a wristwatch including a bracelet provided with a clasp according to the invention.

It is clear from the present description that the clasp according to the present invention comprises a device for adjusting the useful length of the bracelet that is simple in structure and easy to manipulate, while retaining a discrete aesthetic appearance and a reduced space requirement.

The above description endeavours to describe a particular embodiment by way of non-limiting illustration and the invention is not restricted to the implementation of certain particular features that have just been described such as, for example, the forms specifically illustrated and described for the strips or their mode of cooperation to ensure the locking of the clasp.

Those skilled in the art will not encounter any particular difficulty in adapting the content of the present disclosure to their individual requirements and in implementing a clasp, in particular for a timepiece, without departing from the scope of the invention. It will be noted for example that those skilled in the art will not have any particular difficulty in adapting the teaching herein to the design of an unfolding buckle having a different structure from that illustrated and described here.

Moreover, the clasp according to the present invention is not restricted to the use of two positions for adjusting the useful length of the bracelet. In fact, those skilled in the art will likewise not encounter any particular difficulty in adapting the present teaching to configure a clasp having a larger number of possible adjustment positions.

What is claimed is:

1. A clasp for a bracelet of the type comprising first and second free ends, wherein the clasp comprises:

first and second bracelet fastening members configured to be made respectively integral with said first and second free ends of the bracelet, wherein the first and second bracelet fastening members are movable in relation to one another between at least one open position and a closed wearing position, in which the first and second bracelet fastening members are closer to one another than in the open position, to close the bracelet and define a useful length therefore;

at least one locking member arranged to hold the first and second bracelet fastening members in the closed position thereof;

at least one control member for the locking member, wherein the control member is arranged to unlock the clasp in response to an action of a user and to change from said closed position to said open position;

an adjusting device for adjusting the useful length of the bracelet comprising:

an adjusting member carrying said first bracelet fastening member, and at least one lock capable of having a default closed state, in which the adjusting member is fixed, and an open state, in which the adjusting member is free to slide in the direction of the length of the bracelet with respect to the second bracelet fastening member to modify the useful length of the bracelet, wherein the adjusting device is distinct from the locking member, and the lock is arranged to change from the closed state to the open state thereof by action of the user on the control member of the locking member such that the adjusting member is capable of being shifted independently of the open or closed state of the clasp, wherein the control member comprises a push-piece capable of being displaced in a substantially perpendicular direction to the longitudinal direction of the bracelet in response to an action of the user, wherein the push-piece is independent of the lock.

2. The clasp according to claim 1, wherein the adjusting member comprises a support structure carrying the first bracelet fastening member and at least one finger arranged to cooperate with the lock, wherein the lock comprises a plate, which is adjacent to the support structure and in which a slot is arranged in the longitudinal direction of the bracelet, wherein the slot has at least two notches capable of cooperating with the finger in the closed state of the lock to define two different respective useful lengths of the bracelet, and wherein the finger is capable of sliding into the slot in the open state of the lock to pass from one notch to the other and modify the useful length of the bracelet.

3. The clasp according to claim 2, wherein the support structure comprises upper and lower walls, between which the plate is arranged, and wherein the finger has the form of a screw securing the upper and lower walls to one another.

4. The clasp according to claim 3, wherein the upper wall is formed by a cover comprising an upper surface carrying lateral walls having two holes intended to accommodate the ends of a bracelet strand fastening bar, and at least one support surface against which the lower wall is held by means of the screw.

5. The clasp according to claim 4, wherein the clasp has an additional control member, wherein the control members is similar and symmetrical with respect to the longitudinal direction of the bracelet, and wherein the adjusting device comprises:

an additional lock associated with the additional control member, wherein the lock is similar and symmetrical relative to the longitudinal direction of the bracelet, and an additional finger associated with the additional lock.

6. The clasp according to claim 1, of the type having a buckle of the unfolding type including at least a first and a second strips hinged to each other, of which the first strip includes two posts that are symmetrical with reference to the longitudinal direction of the bracelet, inserted into a substantially complementary recess in the second strip to place the clasp in the closed position thereof, by momentarily moving the posts closer together against the force of elastic return means, wherein each of the two posts carries one of the locks, and wherein the push-pieces abut against the locks and are slidably engaged through corresponding apertures arranged in the lateral walls of the cover and in which the push-pieces are retained by rims which extend on both sides of the push-pieces.

7. The clasp according to claim 6, wherein in the closed position of the clasp, corresponding thickened portions of the two posts are in mesh with the inner edges of the second strip so as to maintain the closed state of the clasp.

8. The clasp according to claim 7, wherein each inner edge of the second strip has a hollow, in which the corresponding thickened portions of the two posts are engaged when the clasp is closed.

9. The clasp according to claim 1, wherein the adjusting device comprises at least one elastic member exerting a force on said lock or locks tending to hold said lock or locks in the closed state.

10. The clasp according to claim 9, wherein the adjusting device comprises an intermediate member whose position is fixed relative to the lock and having a support surface for one end of the elastic member.

11. The clasp according to claim 10, wherein the adjusting device comprises a ball click associated with at least two substantially complementary openings arranged to index at least two configurations of the adjusting device corresponding to two different useful lengths of the bracelet.

12. The clasp according to claim 11, wherein the ball click is carried by the intermediate member.

13. The clasp according to claim 12, wherein the support structure comprises upper and lower walls, between which the plate is arranged, and wherein the finger has the form of a screw securing the upper and lower walls to one another, and wherein the openings are arranged in the upper wall of said adjusting device.

14. The clasp according to claim 11, wherein the support structure comprises upper and lower walls, between which the plate is arranged, and wherein the finger has the form of a screw securing the upper and lower walls to one another, and wherein the openings are arranged in the upper wall of the adjusting device.

15. The clasp according to claim 1, wherein the unlocking of the clasp is associated with a displacement of the control member of a first amplitude d1, and the unlocking of the adjusting member by the lock is associated with a displacement of the control member of a second amplitude d2, wherein d1 is less than d2.

16. The wristwatch including a bracelet provided with a clasp according to claim 1.

* * * * *